US009441803B2

(12) United States Patent
Tsukamoto

(10) Patent No.: US 9,441,803 B2
(45) Date of Patent: Sep. 13, 2016

(54) VEHICULAR HEADLAMP

(75) Inventor: Michio Tsukamoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 394 days.

(21) Appl. No.: 13/305,018

(22) Filed: Nov. 28, 2011

(65) Prior Publication Data

US 2012/0140505 A1 Jun. 7, 2012

(30) Foreign Application Priority Data

Dec. 2, 2010 (JP) ..... 2010-269447

(51) Int. Cl.

| | |
|---|---|
| ***F21S 8/10*** | (2006.01) |
| *F21V 7/00* | (2006.01) |
| *F21V 7/06* | (2006.01) |

(52) U.S. Cl.

CPC ..... *F21S 48/1104* (2013.01); *F21S 48/1154* (2013.01); *F21S 48/1305* (2013.01); *F21S 48/1317* (2013.01); *F21S 48/1388* (2013.01); *F21V 7/0025* (2013.01); *F21V 7/0033* (2013.01); *F21V 7/06* (2013.01)

(58) Field of Classification Search

CPC .. F21S 48/00; F21S 48/1131; F21S 48/1388; F21S 48/1283; F21S 48/1305; F21S 48/1335; F21S 48/1154; B60Q 3/001; B60Q 1/20; F21V 7/0025; F21V 7/0033; F21V 7/06; F21V 14/006

USPC ..... 362/538, 539, 543–545, 293, 362/296.01–307, 84

See application file for complete search history.

(56) References Cited

U.S. PATENT DOCUMENTS

| | | | | |
|---|---|---|---|---|
| 1,300,202 | A * | 4/1919 | Stubblefield | 362/303 |
| 1,643,086 | A * | 9/1927 | Pike et al. | 362/299 |
| 1,883,360 | A * | 10/1932 | Fortney | 362/510 |
| 5,142,387 | A * | 8/1992 | Shikama et al. | 349/9 |
| 5,927,849 | A * | 7/1999 | Cassarly et al. | 362/551 |

(Continued)

FOREIGN PATENT DOCUMENTS

| | | |
|---|---|---|
| CN | 1619210 | 5/2005 |
| JP | 2008257013 | 10/2008 |

(Continued)

OTHER PUBLICATIONS

Chinese Office Action—Chinese Application No. 201110397455.8 issued on Jun. 3, 2014, citing CN 1619210A.

*Primary Examiner* — Jong-Suk (James) Lee
*Assistant Examiner* — Zheng Song
(74) *Attorney, Agent, or Firm* — Abelman, Frayne & Schwab

(57) ABSTRACT

Disclosed is a vehicular headlamp which includes a lamp unit placed in a lamp unit outer case constituted by an outer cover and a lamp housing. The lamp unit includes a light emitting diode provided as a light source; a circuit substrate mounted with the light emitting diode and having a connection terminal for supplying power to the light emitting diode; a projection lens configured to project light emitted from the light emitting diode and irradiate the projected light forwardly; and a cover member placed to surround the light emitting diode and include a colored part of which an inner peripheral surface is formed as an incident surface, on which a part of the light emitted from the light emitting diode is incident, and in which a predetermined color other than a yellow color is given to a surface other than the incident surface.

11 Claims, 3 Drawing Sheets

(56) References Cited

U.S. PATENT DOCUMENTS

| | | | | |
|---|---|---|---|---|
| 6,206,554 | B1 * | 3/2001 | Schuster et al. | 362/518 |
| 6,469,322 | B1 * | 10/2002 | Srivastava et al. | 257/89 |
| 6,488,396 | B1 * | 12/2002 | Hayakawa et al. | 362/539 |
| 7,419,290 | B2 * | 9/2008 | Inaba | 362/538 |
| 2001/0026456 | A1 * | 10/2001 | Murakoshi et al. | 362/516 |
| 2004/0141330 | A1 * | 7/2004 | Takada | F21S 48/1388 362/516 |
| 2004/0257827 | A1 * | 12/2004 | Ishida et al. | 362/545 |
| 2005/0180157 | A1 * | 8/2005 | Watanabe et al. | 362/543 |
| 2006/0291246 | A1 * | 12/2006 | Hattori et al. | 362/614 |
| 2007/0085103 | A1 * | 4/2007 | Nishioka | H01L 33/507 257/99 |
| 2007/0177401 | A1 * | 8/2007 | Nakabayashi | 362/548 |
| 2008/0062706 | A1 * | 3/2008 | Feldmeier | 362/459 |
| 2008/0116473 | A1 * | 5/2008 | Sugiyama | H01L 33/483 257/98 |
| 2008/0137345 | A1 * | 6/2008 | Wimberly | 362/299 |
| 2009/0059594 | A1 * | 3/2009 | Lin | F21K 9/00 362/294 |
| 2010/0067251 | A1 * | 3/2010 | Tokunaga | 362/547 |
| 2010/0195306 | A1 * | 8/2010 | Helbing et al. | 362/84 |

FOREIGN PATENT DOCUMENTS

| | | |
|---|---|---|
| JP | 2009129558 | 6/2009 |
| JP | 2009-266434 | 11/2009 |
| JP | 2009267102 | 11/2009 |

* cited by examiner

VEHICULAR HEADLAMP

CROSS-REFERENCE TO RELATED APPLICATIONS

This application is based on and claims priority from Japanese Patent Application No. 2010-269447, filed on Dec. 2, 2010, with the Japanese Patent Office, the disclosure of which is incorporated herein in its entirety by reference.

TECHNICAL FIELD

The present disclosure relates to a vehicular headlamp. More particularly, the present disclosure relates to a technical field that intends to prevent light leakage and improve appearance of the vehicular headlamp by providing a cover member that is placed to surround a light emitting diode and has a colored part to which a predetermined color other than yellow color is given to at least a part thereof.

BACKGROUND

There is a vehicular headlamp which uses a light emitting diode (LED) as a light source.

The vehicular headlamp includes a so called direct irradiation type vehicular headlamp in which light emitted from the light emitting diode is not reflected on a reflector but is incident and projected on a projection lens, and thus irradiated forwardly (see, for example, FIG. 2 of Japanese Patent Application Laid-Open No. 2009-266434).

Since the reflector for reflecting light is not provided in the direct irradiation type vehicular headlamp, the number of required components can be reduced and miniaturization can be achieved.

However, in the direct irradiation type vehicular headlamp as described in Japanese Patent Application Laid-Open No. 2009-266434, since the light emitted from the light emitting diode is diffused at a predetermined angular range, light emitted toward an outer circumference side of the projection lens is not used as irradiated light but may become a leaking light. The leaking light may become glaring light to an oncoming vehicle or a preceding vehicle.

Since the light emitting diode (white LED) used as the light source has yellow color, the yellow color of the light emitting diode is viewed from the front through the projection lens when the light emitting diode is turned OFF. In this case, even when the vehicular headlamp is viewed in an inclined direction as well as the direct front side (optical axis direction), yellow color of the light emitting diode is viewed through the projection lens, and as a result, the appearance is degraded.

SUMMARY

The present disclosure has been made in an effort to provide a vehicular headlamp that can prevent light leakage and improve an appearance.

An exemplary embodiment of the present disclosure provides a vehicular headlamp including a lamp unit placed in a lamp unit outer case constituted by an outer cover and a lamp housing. The lamp unit includes a light emitting diode provided as a light source; a circuit substrate mounted with the light emitting diode and having a connection terminal for supplying power to the light emitting diode; a projection lens configured to project light emitted from the light emitting diode and irradiate the projected light forwardly; and a cover member placed to surround the light emitting diode. In particular, the cover member includes a colored part of which an inner peripheral surface is formed as an incident surface on which a part of the light emitted from the light emitting diode is incident. Further, a predetermined color other than yellow color is given to a surface other than the incident surface of the colored part.

Therefore, in the vehicular headlamp, a part of the light emitted from the light emitting diode is incident on an incident surface of the cover member and the light emitting diode becomes a closed state to the cover member depending on a viewing angle.

The vehicular headlamp includes a lamp unit placed in a lamp unit outer case constituted by an outer cover and a lamp housing. In particular, the lamp unit includes, a light emitting diode provided as a light source; a circuit substrate mounted with the light emitting diode and having a connection terminal for supplying power to the light emitting diode; a projection lens configured to project light emitted from the light emitting diode and irradiate the projected light forwardly; and a cover member placed to surround the light emitting diode. In particular, the cover member includes a colored part of which an inner peripheral surface is formed as an incident surface on which a part of the light emitted from the light emitting diode is incident. Further, a predetermined color other than a yellow color is given to a surface other than the incident surface of the colored part.

Therefore, the leaking problem of the light emitted from the light emitting diode can be prevented by the cover member.

When the vehicular headlamp is viewed from the front side, the light emitting diode is not well viewed due to the cover member, such that it is difficult to view the yellow color of the light emitting diode and the appearance can be improved.

According to the vehicular headlamp described above, the incident surface is formed as the reflection surface that reflects the light emitted from the light emitting diode.

Accordingly, the light emitted from the light emitting diode to be incident on the incident surface is reflected and directed toward the projection lens to be used as light that is irradiated forwardly. As a result, the light leakage can be prevented and light efficiency can be improved.

Further, in the vehicular headlamp of the present disclosure, the reflection surface of the cover member includes a front side reflection portion formed as a parabolic surface and a rear side reflection portion positioned adjacent to the rear side of the front side reflection portion. Meanwhile, a part of the light emitted from the light emitting diode is continuously reflected in sequence on the front side reflection portion and the rear side reflection portion to be directed to the projection lens.

Accordingly, since a part of the light emitted from the light emitting diode is used as the light that is irradiated forwardly, the light leakage can be prevented and the light efficiency of light can be improved.

Further, in the vehicular headlamp of the present disclosure, at least an outer periphery of the circuit substrate is closed from the front by the cover member.

Accordingly, when the vehicular headlamp is viewed from the front while the light emitting diode is turned OFF, the circuit substrate is rarely seen, thereby improving the appearance.

Further, the vehicular headlamp of the exemplary embodiment of the present disclosure further includes: a placement member in which the circuit substrate is placed; and a power feeding attachment having a power feeding terminal and attached to the placement member while pushing the circuit substrate to the placement member to connect the power feeding terminal to the connection terminal of the circuit substrate. In the vehicular headlamp, the power feeding attachment is used as the cover member.

Accordingly, since an exclusive power feeding attachment is not required, a manufacturing cost can be reduced due to the decrease in the number of required components.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, an exemplary embodiment for implementing a vehicular headlamp of the present disclosure will be described with reference to the accompanying drawings.

A vehicular headlamp 1 is placed at each of both ends of a vehicle body.

Figure 1:
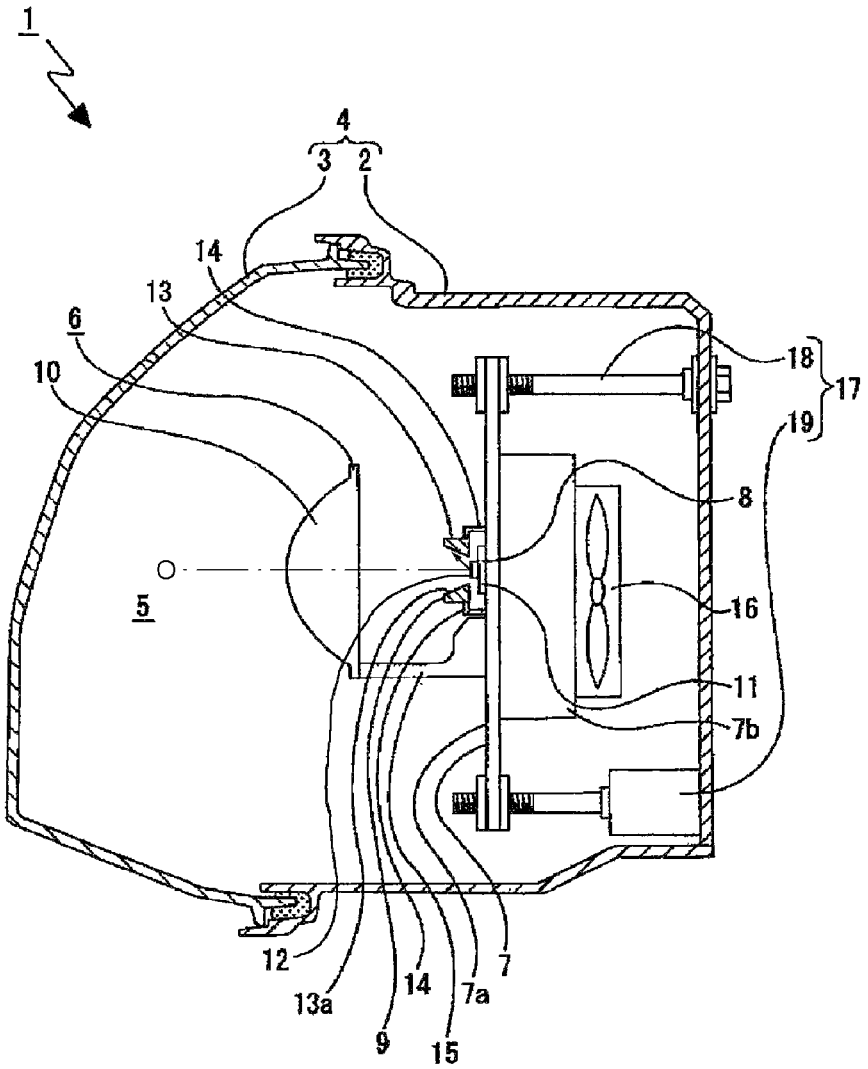
FIG. 1 illustrates a schematic horizontal cross-sectional view of a vehicular headlamp according to an exemplary embodiment of the present disclosure.

As shown in FIG. 1, vehicular headlamp 1 includes a lamp housing 2 having a concave portion opened on the front and an outer cover 3 closing an opened surface of lamp housing 2. A lamp apparatus outer case 4 is constituted by lamp housing 2 and outer cover 3. An inner part of lamp apparatus outer case 4 is formed as a lamp chamber 5.

A lamp unit 6 is placed in lamp chamber 5. Lamp unit 6 is, for example, a so-called lamp unit for a high beam that irradiates light over long distance.

Lamp unit 6 includes a placement member 7, a light emitting unit 8, a cover member 9, and a projection lens 10. Lamp unit 6 is a so-called projector type lamp unit irradiating light emitted from a light source of light emitting unit 8 without reflecting by a reflector.

A front surface of placement member 7 is formed as a placement surface 7*a*. A plurality of heat dissipating fins 7*b* is provided on a rear surface of placement member 7 (only one is shown in FIG. 1).

Light emitting unit 8 includes a circuit substrate 11 and a light emitting diode 12 mounted on circuit substrate 11. A connection terminal (not shown) is provided on circuit substrate 11 and power is supplied to light emitting diode 12 through the connection terminal.

A white LED is used as light emitting diode 12 and the color of the white LED is yellow.

Cover member 9 includes a colored part 13 and attached parts 14 and 14.

Colored part 13 has a circular shape in which an axial direction corresponds to a forward-backward direction and colors other than the yellow color, such as a blue color, a green color, and a purple color are given to the surface of colored part 13. The color given to colored part 13 may be a color other than a red color or an orange color.

An inner peripheral surface of colored part 13 is formed as an incident surface 13*a* which is inclined toward outside as it goes forward. Incident surface 13*a* is formed as a light blocking surface or a reflection surface.

One end of each of attached parts 14 and 14 is coupled to an outer peripheral surface of colored part 13, and the other end of each attached part 14 is attached to placement surface 7*a* of placement member 7.

Colored part 13 is placed to cover light emitting diode 12 and a rear surface of colored part 13 is substantially the same position as a front surface (light emitting surface) of light emitting diode 12 in the forward-backward direction.

Projection lens 10 has, for example, a substantially semi-circular shape which is convex to the forward side. Projection lens 10 is held in front of light emitting unit 8 by a holding member 15 attached to placement member 7.

A fan 16 is attached onto the rear surfaces of heat dissipating fins 7*b* provided on a rear surface of placement member 7. The heat from circuit substrate 11 generated when light emitting diode 12 emits light is dissipated by dissipating fins 7*b* and fan 16, and, as a result, circuit substrate 11 is cool down.

Lamp unit 6 is supported on lamp housing 2 to be tiltable by an optical axis adjusting mechanism 17. Optical axis adjusting mechanism 17 includes aiming screws 18 and a leveling actuator 19. Aiming screws 18 (only one is shown in FIG. 1) are placed at positions that connects both upper and lower ends of placement member 7 and both upper and lower ends of lamp housing 2, respectively. Leveling actuator 19 is positioned at a lower end of lamp chamber 5 and connected to the lower end of placement member 7.

In lamp unit 6, the light emitted from light emitting diode 12 passes through the inside of cover member 9, and thereafter, penetrates projection lens 10 and outer cover 3 in sequence to be irradiated forwardly. In this case, a part of the light passing through the inside of cover member 9 is incident on incident surface 13*a*.

When incident surface 13*a* is formed as the light blocking surface, the light incident on incident surface 13*a* is absorbed in incident surface 13*a* to prevent light leakage.

Meanwhile, when incident surface 13*a* is formed as the reflection surface, the light on incident surface 13*a* is reflected toward projection lens 10 and is used as an irradiation light to the forward direction. Therefore, in this case, the light leakage can be prevented and the light efficiency can be improved.

When incident surface 13*a* is formed as the reflection surface, a color given to incident surface 13*a* may not be reflected to the light which is irradiated forwardly by lowering the reflectivity of the reflection surface. Further, incident surface 13*a* may be colored lightly.

In vehicular headlamp 1, at least an outer periphery of circuit substrate 11 is closed from the front by cover member 9. Accordingly, when vehicular headlamp 1 is viewed from the front while light emitting diode 12 is turned OFF, circuit substrate 11 is rarely seen, and, as a result, the appearance can be improved.

Hereinafter, a modified example of the cover member will be described (see FIGS. 2 to 4).

Figure 2:
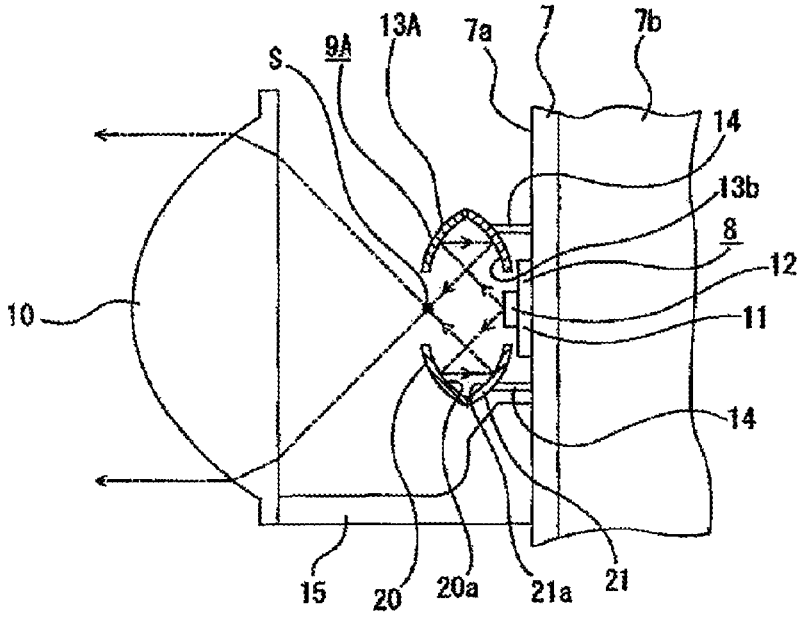
FIG. 2 is an enlarged cross-sectional view of a cover member according to a first modified example.

A cover member 9A according to a first modified example includes a colored part 13A and attached parts 14 and 14 (see FIG. 2).

Colored part 13A is formed in a circular shape in which an axial direction corresponds to a forward-backward direction and formed by coupling a front side portion 20 and a rear side portion 21 having the same shape and size with each other in the forward-backward direction. Front side portion 20 and rear side portion 21 have parabolic surfaces formed as a front side reflection portion 20*a* and a rear side reflection portion 21*a*, respectively, and outer peripheries of front side portion 20 and rear side portion 21 are coupled with each other so that front side reflection portion 20*a* faces substantially toward a rear side, and rear side reflection portion 21*a* faces substantially toward a front side. Front side reflection portion 20*a* and rear side reflection portion 21*a* become incident surfaces 13*b* on which light emitted from light emitting diode 12 is incident.

Colors other than the yellow color are given to the surface of colored part 13A other than front side reflection portion 20*a* and rear side reflection portion 21*a*, as in colored part 13. The colors given to colored part 13A may be colors other than the red color or the orange color as in colored part 13.

Colored part 13A is placed to cover light emitting diode 12 and a rear end of colored part 13A is positioned at an outer peripheral side of light emitting diode 12.

In vehicular headlamp 1 using cover member 9A, a focus S of projection lens 10 is positioned near the center at a front end of cover member 9A.

When the light is emitted from light emitting diode 12, a part of the emitted light is continuously reflected in sequence on front side reflection portion 20*a* and rear side reflection portion 20*b* of front portion 20 and penetrates the inside of cover member 9A to be directed to projection lens 10 and thereafter, passes through projection lens 10 and outer cover 3 in sequence to be irradiated forwardly.

In cover member 9A, a part of the light emitted from light emitting diode 12 is reflected twice on front side reflection portion 20*a* and rear side reflection portion 20*b* formed as incident surfaces 13*b* to be directed to projection lens 10, and is used as the light that is irradiated forwardly. Therefore, the light leakage can be prevented and light efficiency can be improved.

Since light emitting diode 12 is located at the more rearward position than focus S of projection lens 10, light emitting diode 12 is rarely seen when vehicular headlamp 1 is viewed from the front side while light emitting diode 12 is turned OFF, thereby improving the appearance.

Also, since at least the outer periphery of circuit substrate 11 is closed from the front by cover member 9A, circuit substrate 11 is rarely seen when vehicular headlamp 1 is viewed from the front side while light emitting diode 12 is turned OFF, thereby improving the appearance.

Figure 3:
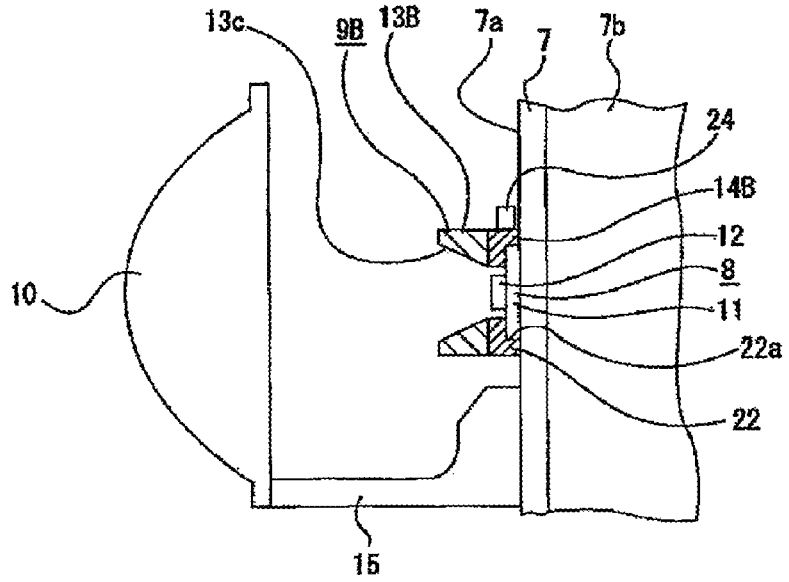
FIG. 3 is an enlarged cross-sectional view of a cover member according to a second modified example.
Figure 4:
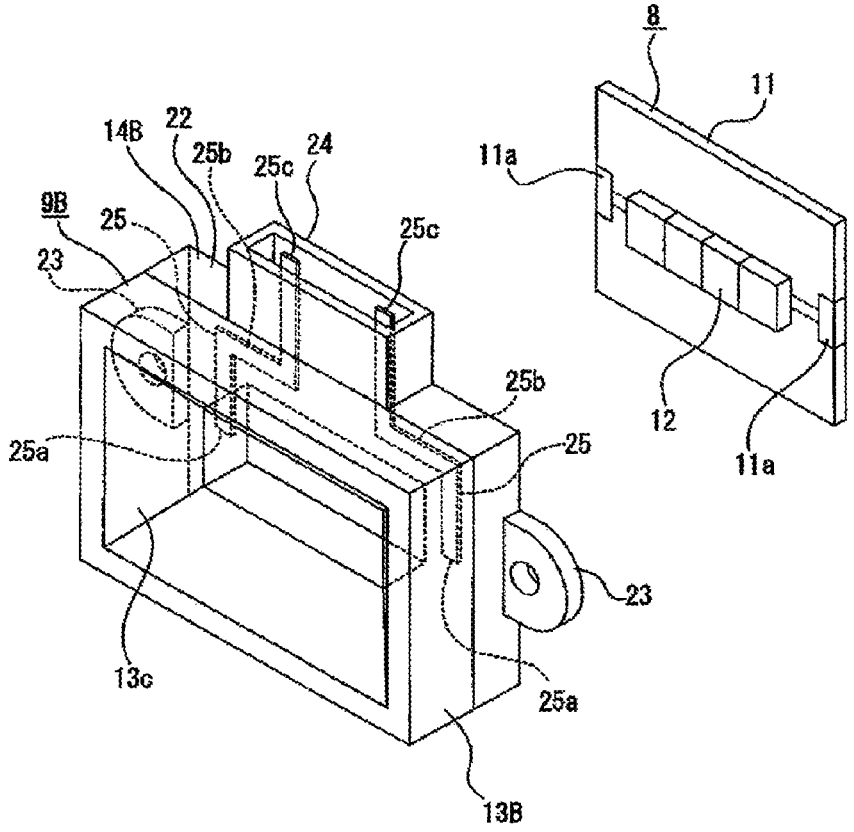
FIG. 4 is an enlarged perspective view of the cover member according to the second modified example.

A cover member 9B according to a second modified embodiment includes a colored part 13B and attached parts 14B (see FIGS. 3 and 4). Cover member 9B serves as a power feeding attachment for feeding power to light emitting diode 12.

Colored part 13B is, for example, formed in a frame shape elongated in transversal direction and the colors other than the yellow color are given to the surface of colored part 13B, as in colored parts 13 and 13A. The colors given to colored part 13B may also be colors other than the red color or the orange color, similarly as colored parts 13 and 13A.

The inner peripheral surface of colored part 13 is formed as an incident surface 13*c* which is more inclined toward outside as it goes forward. Incident surface 13*c* is formed as the light blocking surface or the reflection surface.

Attached part 14B includes a base portion 22 which has the frame shape elongated in transversal direction, screw fixed protrusions 23 that protrudes sideward from both left and right sides of base portion 22, and a connector portion 24 that protrudes upward from a top surface of base portion 22 and is formed in a box shape which is opened toward upwardly. Attached part 14B may be formed integrally with colored part 13B, and further, may be separated from colored part 13B to be attached to colored part 13B.

An outer shape of base portion 22 has the same size and shape as that of colored part 13B, and an inner shape of base portion 22 has the same size and shape as that of a rear surface of colored part 13B. For example, a front surface of base portion 22 is attached to the rear surface of colored part 13B.

Power feeding terminals 25 are provided across connector portion 24 from base portion 22. Power feeding terminals 25 include connection portions 25*a* positioned at both left and right ends of base portion 22, respectively, power feeding portions 25*b* positioned in connector portion 24, and connection portions 25*c* that connect connection portions 25*a* and power feeding portions 25*b*, respectively, and are positioned in base portion 22. Connection portions 25*a* are exposed to the rear surface of base portion 22.

A placement groove 22*a* that is opened inwardly and rearwardly and extended in a circumferential direction thereof is formed on the rear side surface of base portion 22.

In cover member 9B configured as above, screw fixing portions 23 are screw-fixed and attached to placement member 7 while the outer periphery of circuit substrate 11 is inserted into placement groove 22*a*, and circuit substrate 11 is pushed and attached onto placement surface 7*a* of placement member 7, such that light emitting unit 8 is placed in placement member 7. In this case, connection portions 25*a* of power feeding terminals 25 are pressed from the front to contact connection terminals 11*a* and 11*a* formed on circuit substrate 11.

A connector of a power supply cord (not shown) connected to a power supply circuit (not shown) is connected to connector portion 24 and power is supplied from the power supply circuit to light emitting diode 12 through the power supply cord, power feeding terminals 25, and connection terminals 11*a*.

As described above, while cover member 9B is attached to placement member 7 and light emitting unit 8 is placed in placement member 7, colored part 13B is placed to cover light emitting diode 12 and the rear end of colored part 13B is positioned at the outer peripheral side of light emitting diode 12.

When light is emitted from light emitting diode 12, the emitted light passes through the inside of cover member 9B and thereafter, penetrates projection lens 10 and outer cover 3 in sequence to be irradiated forwardly. In this case, a part of the light passing through the inside of cover member 9B is incident on incident surface 13*c*.

When incident surface 13*c* is formed as the light blocking surface, the light incident on incident surface 13*c* is absorbed in incident surface 13*c* to prevent light leakage.

Meanwhile, when incident surface 13*c* is formed as the reflection surface, the light incident on incident surface 13*c* is reflected to be directed to projection lens 10 and is used as light which is irradiated forwardly. Therefore, in this case, the light leakage can be prevented and light efficiency can be improved.

When incident surface 13*c* is formed as the reflection surface, the color given to incident surface 13*c* may not be reflected to the light which is irradiated forwardly by lowering the reflectivity of the reflection surface. Incident surface 13*c* may be light-colored.

At least the outer periphery of circuit substrate 11 is closed from the front by cover member 9B. Accordingly, when vehicular headlamp 1 is viewed from the front side while light emitting diode 12 is turned OFF, circuit substrate 11 is rarely seen to improve the appearance.

Since cover member 9B serves as the power feeding attachment, an exclusive power feeding attachment is not required, and as a result, a manufacturing cost can be reduced due to the decrease in the number of required components.

In the above description, although colored part 13B which is formed in a rectangular frame shape is provided in cover member 9B, for example, colored part 13A on which the light emitted from light emitting diode 12 is reflected twice may be provided, instead of colored part 13B.

As described above, in vehicular headlamp 1 with cover bodies 9, 9A, and 9B, the light leaking can be prevented from the light emitted from light emitting diode 12 by cover bodies 9, 9A, and 9B, and glaring light can be prevented due to the prevention of the light leakage.

When vehicular headlamp 1 is viewed, light emitting diode 12 cannot be seen by cover bodies 9, 9A, and 9B, and as a result, the yellow color of light emitting diode 12 is rarely seen to improve the appearance. In particular, when vehicular headlamp 1 is viewed from a position deviated from the optical axis direction, light emitting diode 12 is closed by cover bodies 9, 9A, and 9B. As a result, the yellow color of light emitting diode 12 is not seen but the colors given to cover bodies 9, 9A, and 9B are seen to improve the appearance.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A direct irradiation type vehicular headlamp, comprising:

a lamp unit outer case constituted by an outer cover and a lamp housing;

a circuit substrate mounted with a light emitting diode of a yellow color serving as a light source and having a connection terminal for supplying power to the light emitting diode;

a placement member configured to place the circuit substrate;

a projection lens configured to receive light emitted from a main optical axis of the light emitting diode directly without using a reflector and project the received light forwardly; and a cover member including a colored part and an attached part, and being inwardly extended to surround the light emitting diode from a front surface of the placement member such that the cover member blocks a portion of the light diffused to a peripheral side of the projection lens but does not block the main optical axis of the light emitting diode, and absorbs the portion of the light diffused to the peripheral side of the projection lens, wherein a rear surface of the colored part is substantially the same position as a front surface of the light emitting diode in a forward-backward direction, an inner peripheral surface of the colored part is formed as an incident surface on which the portion of the light diffused to a peripheral side of the projection lens is incident, one end of the attached part is coupled to an outer peripheral surface of the colored part and the other end is attached to the surface of the placement member, a predetermined color other than the yellow color of the light emitting diode is given to the incident surface of the colored part of the cover member, the cover member is disposed such that at least an outer periphery of the circuit substrate is blocked by the cover member when viewed from a front side of the vehicular headlamp, and the attached part includes a base portion formed in a box shape opened toward upwardly, a placement groove that is opened inwardly and rearwardly and extended in a circumferential direction thereof is formed on a rear side surface of the base portion, and the outer periphery of the circuit substrate is inserted into the placement groove.

2. The vehicular headlamp of claim 1, wherein the colored part is formed by coupling a front side portion and a rear side portion having the same shape and size with each other in a forward-backward direction and having parabolic surfaces formed as a front side reflection portion and a rear side reflection portion, respectively.

3. The vehicular headlamp of claim 2, wherein the front side reflection portion and the rear side reflection portion are the incident surfaces.

4. The vehicular headlamp of claim 2, wherein the light emitted from the main optical axis of the light emitting diode is reflected twice on the front side reflection portion and the rear side reflection portion to be directed to the projection lens.

5. The vehicular headlamp of claim 2, wherein one end of the rear side portion is coupled to the front side portion and the other end of the rear side portion is positioned above or below an outer peripheral surface of the light emitting diode.

6. The vehicular headlamp of claim 1, wherein the incident surface of the cover member is formed to be inclined toward outside of the lamp unit outer case as the incident surface goes forward.

7. The vehicular headlamp of claim 6, further comprising a power feeding attachment with a power feeding terminal and attached to the placement member while pushing the circuit substrate to the placement member to connect the power feeding terminal to the connection terminal of the circuit substrate, wherein the power feeding attachment is used as the cover member.

8. The vehicular headlamp of claim 1, further comprising a power feeding attachment with a power feeding terminal and attached to the placement member while pushing the circuit substrate to the placement member to connect the power feeding terminal to the connection terminal of the circuit substrate, wherein the power feeding attachment is used as the cover member.

9. The vehicular headlamp of claim 1, wherein a rear surface of the colored part having the same size and shape as those of a front surface of the base portion is attached to the front surface of the base portion such that the cover member horizontally surrounds the light emitting diode.

10. The vehicular headlamp of claim 1, wherein the cover member is configured to serve as a power feeding attachment for feeding a power to the light emitting diode.

11. The vehicular headlamp of claim 1, wherein a connector portion protruded upward from a top surface of the base portion is formed in a box shape which is opened toward upwardly.

* * * * *